United States Patent [19]

Heinrich et al.

[11] Patent Number: 4,712,481

[45] Date of Patent: Dec. 15, 1987

[54] ADDITIVE SEALING SLEEVE FOR A PROPELLENT CHARGE FOR LARGE-CALIBERED AMMUNITION FIRED FROM BARRELED WEAPONS

[75] Inventors: Hansjorg Heinrich, Leinburg; Josef Kraft, Schnaittach, both of Fed. Rep. of Germany

[73] Assignee: Diehl GmbH & Co., Nuremberg, Fed. Rep. of Germany

[21] Appl. No.: 942,874

[22] Filed: Dec. 17, 1986

[30] Foreign Application Priority Data

Dec. 19, 1985 [DE] Fed. Rep. of Germany ..... 3544927

[51] Int. Cl.[4] ..... F42B 5/02

[52] U.S. Cl. ..... 102/435; 102/430; 102/464

[58] Field of Search ..... 102/430, 435, 464

[56] References Cited

U.S. PATENT DOCUMENTS

| | | | |
|---|---|---|---|
| 3,282,215 | 11/1966 | Roth | 102/435 |
| 3,362,328 | 1/1968 | Katz | 102/435 |
| 3,426,684 | 11/1969 | Jacobson et al. | 102/435 |

*Primary Examiner*—Harold J. Tudor

*Attorney, Agent, or Firm*—Scully, Scott, Murphy & Presser

[57] ABSTRACT

An additive sealing or packing sleeve for a propellent charge employed for large-calibered ammunition which is fired from a barrelled weapon or launch tube, which is glued into a shell or cartridge casing. The sleeve consists of a fabric constituting a support for a mixture of wax and titanium dioxide, in which the mixture is covered towards the inside by a polyethylene sheeting, and in which the side of the polyethylene sheeting facing inwardly towards the propellent charge is fully covered by a textile material.

3 Claims, 3 Drawing Figures

ADDITIVE SEALING SLEEVE FOR A PROPELLENT CHARGE FOR LARGE-CALIBERED AMMUNITION FIRED FROM BARRELED WEAPONS

BACKGROUND OF THE INVENTION

1. Field of the Invention

The present invention relates to an additive sealing or packing sleeve for a propellent charge employed for large-calibered ammunition which is fired from a barrelled weapon or launch tube, which is glued into a shell or cartridge casing, which consists of a fabric constituting a support for a mixture of wax and titanium dioxide, and in which the mixture is covered towards the inside by a polyethylene sheeting.

2. Discussion of the Prior Art

In the usual additive sealing sleeve, there is encountered a phlegmatizing or desensitizing of the propellent powder through the rub-off of wax from the surface of the mixture which is constituted of wax and titanium dioxide during environmental investigations at high temperatures of +63° C. As a consequence, there is produced an extremely non-uniform internal and external ballistic characteristic. The usual protective sheeting constituted of polyethylene fails to provide the strength to withstand the encountered mechanical loading. Moreover, the melting ranges and viscosities of the mixture are also considerably dependent upon the employed manufacturing methods, and can also not be maintained within precise bounds from a standpoint of the available production technology. As a result thereof, there is also present an extremely differing phlegmatizing or desensitizing of the propellent powder.

SUMMARY OF THE INVENTION

Accordingly, it is an object to provide an additive sealing sleeve in which the mechanical loads will, at high temperatures, prevent any phlegmatizing or desensitizing of the powder through the rub-off of wax.

The foregoing object is readily attained for an additive sealing sleeve of the type described herein, in that the polyethylene sheeting is completely covered facing towards the propellant through the intermediary of a textile material which is based on either cotton, synthetic silk or rayon, and is connected by at least one seam with the additive sealing sleeve.

Further features of the invention may be readily ascertained from the detailed description thereof as set forth hereinbelow. The inventive structure prevents with assurance the phlegmatizing or desensitizing of the propellent powder during environmental experimentation, and combusts completely upon firing.

The textile material, which when it is preferably constituted of synthetic silk or rayon, evidences an extremely low coefficient of friction, such that the particles of the propellent will slide along the synthetic silk or rayon during mechanical loading, without damaging the synthetic silk. Consequently, the mixture is protected against any rub-off.

A dependable and inexpensive fastening of the textile material to the additive sealing sleeve is provided, pursuant to the present invention, in that the textile material is folded over both end faces of the additive sealing sleeve, and that the material bonds contacting the outer side together with the internally contacting textile material are connected with the additive sealing sleeve by means of through-extending seams.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figure 1:
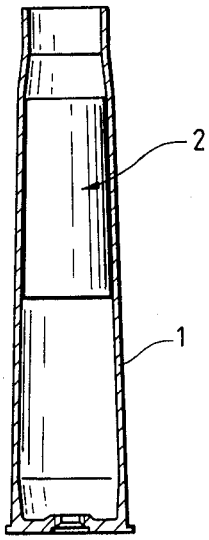
FIG. 1 illustrates a longitudinal sectional view through a shell or cartridge casing with an additive sealing sleeve glued therein.
Figure 2:
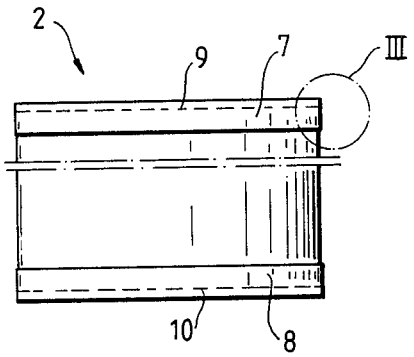
FIG. 2 illustrates the sealing sleeve pursuant to FIG. 1.
Figure 3:
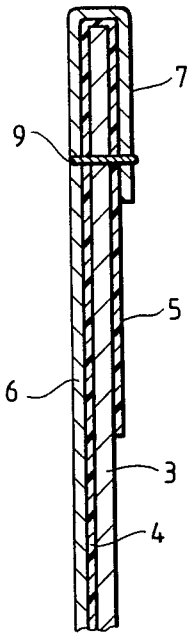
FIG. 3 illustrates a sectional detail, on an enlarged scale, of the encircled portion III in FIG. 2.

A cartridge casing 1 which is constituted of brass has an additive sealing sleeve 2 adhesively glued therein. The additive sealing sleeve 2 consists of a fabric material 3 which incorporates a mixture of wax and titanium dioxide within its fabric. A polyethylene sheeting 4 completely covers the inside of the fabric material 3. At end faces of the material 3, there is folded over the polyethylene sheeting such as to form a band 5 on the rear side of the fabric material.

The polyethylene sheeting, in turn, is fully covered on the inside of the additive sealing sleeve with a layer of a textile material, preferably constituted of synthetic silk or rayon 6. The covering of synthetic silk 6 encompasses the end faces of the fabric material 3, and ends at its rear side in two bands 7, 8. Fabric seams 9, 10 connect the layer constituted of synthetic silk with the fabric material 3.

The webs 7, 8 are in themselves supports or substrates for the adhesive or glue for the fastening of the shell or cartridge casing 1. As a result, there is provided a secure and stable fastening within the cartridge casing.

Environmental experiments at high temperatures of +63° C. leave the additive sealing sleeve undamaged. As a result, there is assuredly prevented any phlegmatizing or desensitizing of the propellent powder (not shown).

What is claimed is:

1. Additive sealing sleeve for a propellent charge for large-calibered ammunition which is fired from barrelled weapons, said sealing sleeve being adhesively fastened within a cartridge casing, said sealing sleeve being constituted of a fabric material forming a support for a mixture of wax and titanium dioxide, wherein said mixture is covered by a polyethylene sheeting; the improvement comprising in that a textile material covers the surface of said polyethylene sheeting facing towards the propellent charge; and at least one seam connecting said textile material with said additive sealing sleeve.

2. Additive sealing sleeve as claimed in claim 1, wherein the textile material is constituted of synthetic silk.

3. Additive sealing sleeve as claimed in claim 1, wherein the textile material is folded over at both end faces of the additive sealing sleeve so as to form bands at both said end faces, and wherein the bands with the inwardly contacting textile material are connected to the additive sealing sleeve by through-extending of said seams.

* * * * *